US005449542A

United States Patent [19]

Chiba et al.

[11] Patent Number: 5,449,542

[45] Date of Patent: Sep. 12, 1995

[54] HONEYCOMB CURTAIN WALL AND A HONEYCOMB PANEL FOR A HONEYCOMB CURTAIN WALL

[75] Inventors: Harumi Chiba, Kobe; Takeaki Baba, Yokohama, both of Japan

[73] Assignee: Sumitomo Light Metal Industries, Ltd., Tokyo, Japan

[21] Appl. No.: 209,801

[22] Filed: Mar. 11, 1994

[30] Foreign Application Priority Data

Mar. 11, 1993 [JP] Japan ..... 5-077704

[51] Int. Cl.[6] ..... B32B 3/12

[52] U.S. Cl. ..... 428/116; 52/793.1

[58] Field of Search ..... 428/73, 116, 117, 118; 52/806

[56] References Cited

U.S. PATENT DOCUMENTS

| | | | |
|---|---|---|---|
| 3,341,049 | 9/1967 | Forman et al. | 428/116 X |
| 3,646,721 | 3/1972 | Becker | 52/809 |
| 3,998,024 | 12/1976 | Frandsen | 428/73 X |
| 4,167,598 | 9/1979 | Logan et al. | 428/116 X |
| 4,577,450 | 3/1986 | Large | 428/116 X |
| 5,240,543 | 8/1993 | Fetterhoff et al. | 428/117 X |
| 5,390,468 | 2/1995 | Probst | 52/806 X |

*Primary Examiner*—Henry F. Epstein

*Attorney, Agent, or Firm*—Flynn, Thiel, Boutell & Tanis

[57] ABSTRACT

A honeycomb curtain wall is made up of composite honeycomb panels with a honeycomb core having t and c (t: plate thickness of the honeycomb core material, c: cell size of the honeycomb core) selected so that the warping amount of the panel by heat distortion becomes less than a specified value in the relationship between the warping amount and t/c and frames placed at the periphery. The composite honeycomb panel can be mounted directly on the building main frame and can withstand outer pressure loads to the exterior walls of the building because the rigidity of the honeycomb panel removes the need for additional bracing. Peripheral frames compose the joining portions of adjacent materials. This structure enables the use of large honeycomb panels and a simple construction process as well as increasing the effective room space of the building due to a reduced total wall thickness.

12 Claims, 7 Drawing Sheets

HONEYCOMB CURTAIN WALL AND A HONEYCOMB PANEL FOR A HONEYCOMB CURTAIN WALL

FIELD OF THE INVENTION

This invention concerns a honeycomb curtain wall and a honeycomb panel used for the honeycomb curtain wall, which is large in size and thickness and withstands pressure loads to the exterior wall of a building with the stiffness provided exclusively by the honeycomb panel. The honeycomb panel does not deform under solar heat cycles.

BACKGROUND OF THE INVENTION

The curtain wall is a building exterior wall fabricated using a number of panels 11 installed side by side as shown in FIG. 8. The installation of the panel 11 is currently made with a vertical frame 13 and a horizontal frame 14. They are locked in place with mounting brackets 15 on vertical sub-frames 12, installed at the edge of a floor portion 5 of the building. The panel 11 is fixed to the frames 13 and 14.

Curtain wall panels are usually made of an aluminum alloy plate 4.5 mm to 6 mm in thickness and installed with formed aluminum frames for reinforcement to give sufficient stiffness. This structure, however, results in design difficulties in the production of large sized panels because uniformity of the panel reinforcement cannot be ensured, and this inevitability results in the use of many panels 11. This also results in an unsatisfactorily close arrangement of the vertical sub-frames 12 and dense arrangement of frames 13 and 14. Existing walls are also subject to distortion through alternate heating by the sun and cooling. Therefore, existing tall building construction requires large quantities of installation materials and processes and frequent delivery of materials. This problem has forced the construction industry to look for a new type of curtain wall using large sized panels.

To solve the above described problems that occur in the use of aluminum alloy plate for paneling, a curtain wall structure using honeycomb panels has been proposed. The honeycomb panel is made with an outer plate of approx. 1.5 mm in thickness and an inner plate approximately 1.0 mm in thickness bonded together, and has an overall thickness of between 15 and 40 mm resulting in greater rigidity and surface flatness as compared with current types made of aluminum alloy plate. This new type of honeycomb panel has the advantage of a high degree of flatness: an essential factor for good external appearance of building panels.

Conventional technical and economical factors do not permit production of panels thicker than the above described examples because of poor production yields of honeycomb core. This limitation requires additional bracing frames to be installed behind the panel to carry its weight and external forces applied on the curtain wall caused by wind pressure and the sun-heating cycle. Additional frames, therefore, are needed on the back of the honeycomb panels. The frames are mounted on the building main frame using mounting brackets. The frames also play the role of joining together and sealing adjacent frames, water sealing and joining to glass panels. External pressures such as wind pressure exerted on the honeycomb panel are transferred to the building main frame through the frames.

As a total structure, honeycomb panels are used only as panels of good flatness and stiffness, being attached to supporting frames. This means that the use of conventional honeycomb panels also requires installation of supporting unit frames, diagonal braces and transoms. These additional members are manufactured separately and assembled on the reverse side of each panel. The frames, therefore, are not stiffness-providing supports of the honeycomb panels but simply part of the assembly, and the warping stiffness becomes a simple sum of the stiffness of each section. This limits the maximum size of larger panels because of comparatively low stiffness per unit weight, besides the additional problem that the total thickness of the panels and the supporting frames becomes inconveniently large. A further problem is that the total thickness of the panel plus its supporting members increases.

Furthermore, the water sealant where the panels are joined together can be no thicker than the honeycomb panels themselves. When thin panels are used, the sealing is done on site using a caulking rubber sealer. This may result in breakage of the seam line caused by thermal expansion and shrinkage if the panel size is large. This phenomenon also limits the size of panels made of thin honeycomb panel.

SUMMARY OF THE INVENTION

One object of this invention is to provide a newly developed honeycomb panel, developed to solve the problems described above and which is large in size, lighter in weight and of higher rigidity than conventional curtain walls.

Another object of this invention is to provide a honeycomb curtain wall that satisfies the need to shorten the length of the joining panels to reduce air and water leakage problems and reduce the wall thickness, increasing the effective floor space of a building as well as increasing panel size and flatness, which are needed for good appearance design of modern tall buildings.

The ideal honeycomb panel takes the form of a large, flat, composite honeycomb panel with supporting frames directly mounted on the main building frame. The frames are placed at the periphery of the honeycomb core and bonded together between face plates. In a building with an exterior curtain wall structure constructed using many panels arranged side by side, the above objects of this invention are achieved by the new panels: (1) to use the stiffness of the panel itself to withstand pressures placed on the exterior walls of the buildings, (2) to permit glass panels to be installed between the frames of the honeycomb panels using packing materials, (3) to include inner frames other than periphery frames in the composite honeycomb panel. The panel is a composite honeycomb panel which has frames located at the periphery of the honeycomb core and a honeycomb core bonded to its surface over the entire surface area. The frames at the periphery of the panel are mounted directly on the building main frame using metal mounts. The frames also make up a joining portion for adjacent components such as neighboring composite honeycomb panels or glass panels.

The honeycomb panel used for this new honeycomb curtain wall is composed of a honeycomb core having (t) and (c); t: material thickness of honeycomb core, c: cell size of honeycomb core, selected for the degree of heat distortion of the panel per unit length to be less than a specified value in consideration of the relation between t/c and the degree of heat distortion per unit length. The panels feature heat insulating material attached to their backside, of a thickness more than 80 mm.

DETAILED DESCRIPTION OF THE PREFERRED EMBODIMENT

Light weight and high rigidity honeycomb panels that have thick cores already exist. This new honeycomb curtain wall is a development of the conventional honeycomb panel and is composed of a composite honeycomb panel made with flat plates and supporting frames placed at specific locations and at the periphery of the honeycomb panel, which is bonded to them. The honeycomb core is formed from very thin metal foil such as aluminum foil, so that it is very light. For example, even though the thickness is tripled, the increase in core weight is quite small. The tripling of the core thickness does not significantly increase the weight provided that the flat plate thickness, the amount of adhesive bonding the core to the plates and the frame weight remain the same.

On the other hand, since the bending rigidity of a honeycomb panel is proportional to the third power of the thickness thereof, the resulted rigidity drastically increases to 27 times that of conventional ones. Accordingly, the new composite honeycomb panels can withstand wind pressure by themselves even when used in tall buildings. This light and high rigidity panel enables an increase in panel size and the reduction of delivery frequency of material as well as a simplified construction process. It can be used as a full height panel extending from floor to floor, or used as a spandrel panel to be installed in combination with glass panels installed at the upper or lower end of the panels. The other end of the panel is mounted on a floor spur utilizing a metal mount. Furthermore, the frames at the periphery of the honeycomb panel or inner frames can also be utilized for attachment to the building main frame and joined to adjacent panels or glass panels. The frames can function as guide rails for a gondola used for cleaning exterior panels, or an opening port.

Since the panel has a thickness of three times or more of that of the conventional one, a balancing-pressure type draining joint can be adopted to prevent the invasion of rain water at the joining part of adjacent panels for maintaining air-tightness and water proof characteristics. The balancing-pressure type draining joint consists of an external rain-proof material and an internal air-tight rubber and introduces outside wind pressure between them. As a result, this system provides high quality, durable waterproofing compared with the conventional sealing method, which is to fill in the seam line with caulking rubber. Guide rail function for the exterior wall cleaning gondola in the room between panels can be provided.

Figure 1:
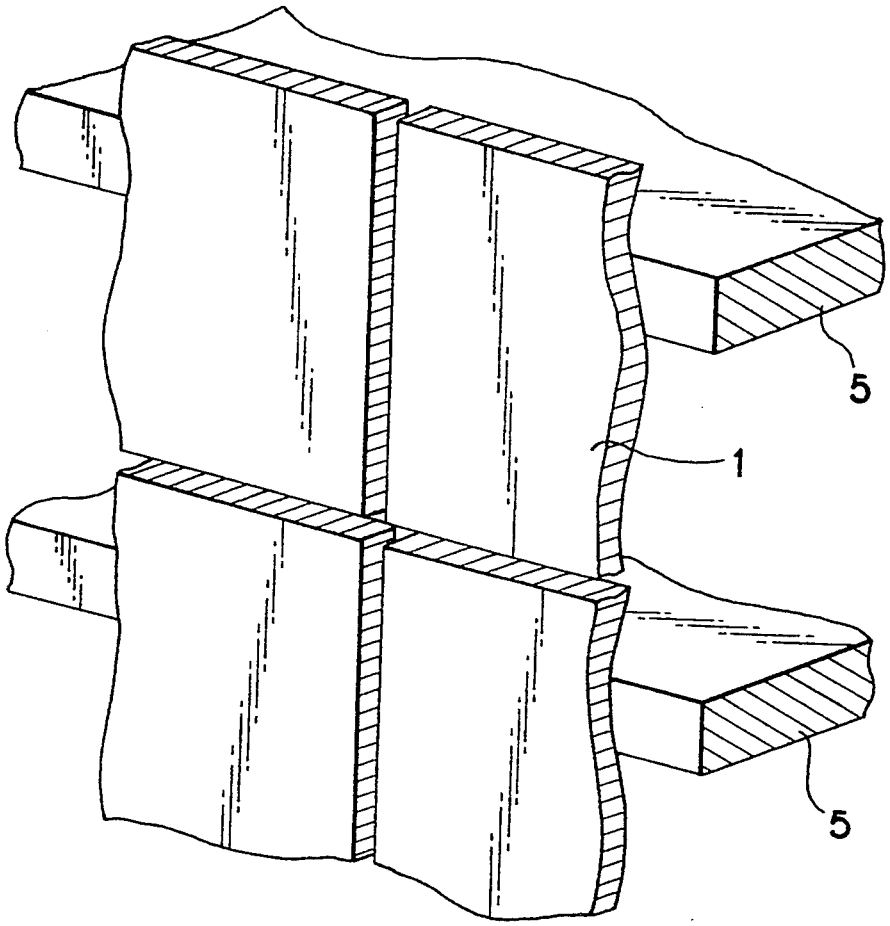
FIG. 1 shows an illustration of the mounting of this new curtain wall.
Figure 2:
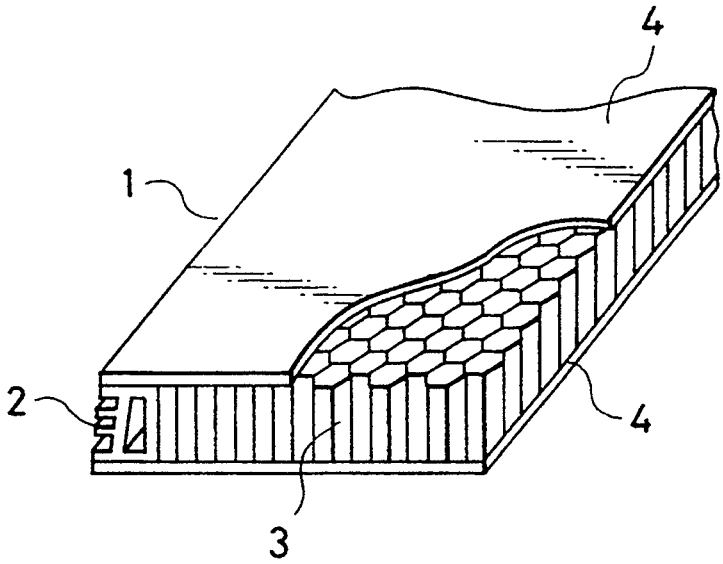
FIG. 2 shows an illustration of the new honeycomb panel.

The shape of this new honeycomb curtain wall structure is, as shown in FIG. 1, made with honeycomb panel 1 (floor height panel) formed in size to cover floors 5 and 6 of the building. This honeycomb panel 1 is, as shown in FIG. 2, a composite honeycomb panel having an aluminum honeycomb core 3 made of aluminum foil of 50~100 μm thickness and frame 2 placed at the periphery of the core, both of whose sides have flat plates 4 made of aluminum alloy plate bonded onto the core. The honeycomb core is made using the following process. (1) An adhesive is painted in an oblong shape on the aluminum foil at specified intervals. (2) The foils are laminated while applying adhesive in a staggered pattern. (3) Portions that do not have adhesive are formed in hexagonal shapes extending in the laminating direction, or parallel portions of processed aluminum foil with a corrugated shape are bonded together. Honeycomb panels with inner frames other than peripheral frames can also be used. The inner frames may be stored inside the flat plates along with core 3 or the frames may be exposed by cutting the flat plate at the frame position.

To maximize strength, it is preferable to use panels of 80 mm or more in thickness. However, a panel as thick as this may cause the temperature difference between inside and outside of the panel to widen, decreasing the flatness of the panel because of the heat expansion difference caused, for example, by air conditioning inside the building and heat from the sun. If the warping caused by the heat expansion difference is restrained by force or there is a difference in tension between the surface plates and the inner structure because of the heat capacity of the frames being larger than the honeycomb core and surface plates, the bonded portions suffer shearing stress sufficient to destroy the bonds between the frames and the surface plates through long-term fatigue.

To solve this problem, the honeycomb panel used in the new honeycomb curtain wall has honeycomb cores having t (plate thickness composing the honeycomb core) and c (honeycomb size) selected and determined from the t/c range to demonstrate a degree of warp lower than a specific value to maintain flatness even under sun heat cycle stress conditions. The specified value is obtained from the relationship between t/c and degree of warp per unit length on the basis of heat applied to the panel. This was determined in experiments to measure the degree of warp per unit length while subjecting the honeycomb panel to a heat cycle test. In addition to the use of honeycomb cores, the temperature difference is controlled to keep it within the range needed to prevent panel warp and adhesive fatigue by maintaining heat conduction between both surface plates at the desired level via the honeycomb cores and by placing heat insulating materials over the entire reverse side of the panel.

Figure 3:
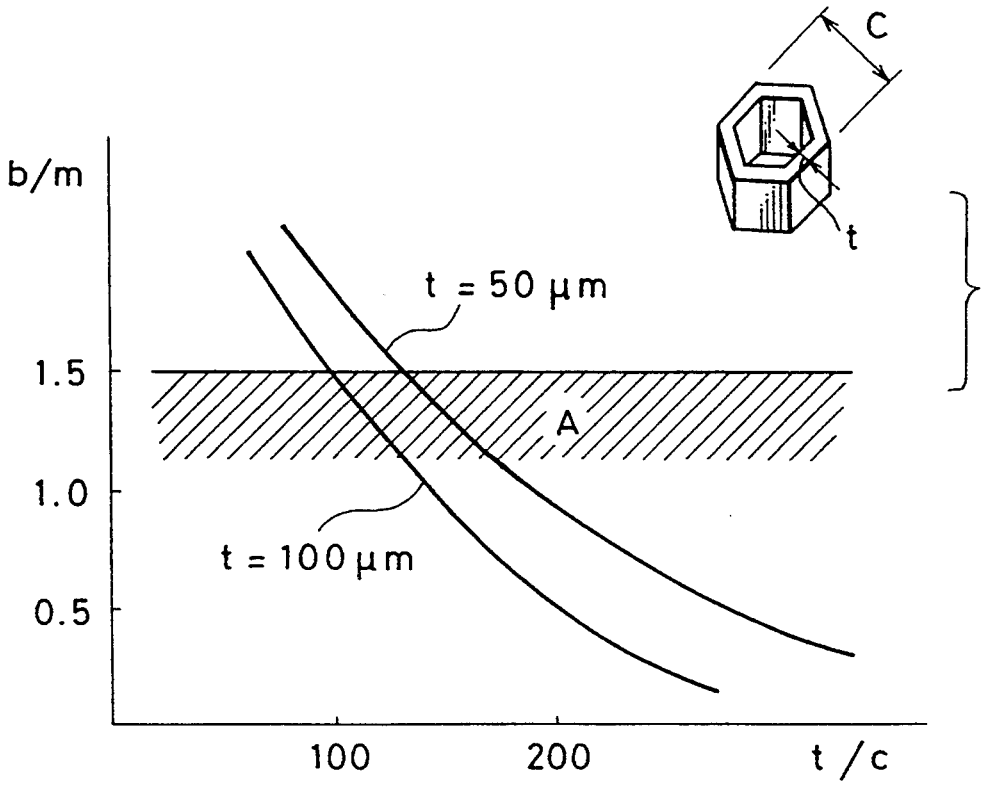
FIG. 3 shows relational parameters between the degree of warp and t/c to specify dimensions of the honeycomb core making the new honeycomb panel.

FIG. 3 is a graph showing the relationship between t/c (t:μm, c:inch) and degree of deformation amount (b:mm) of the panel per unit length (1 m) in vertical direction to the surface of the panel obtained from a thermal load test on the honeycomb panel with a honeycomb core made of aluminum foil. The required t(μm) and c(inch) value for a specific degree of said deformation b(mm) per 1 m, for example the degree of the deformation to be less than 1.5 mm, are obtained from varying the range of A as a parameter. Honeycomb cores with a selected core thickness and cell size are used to make a honeycomb panel to be used as a section of the honeycomb curtain wall.

A honeycomb panel made with honeycomb cores having t and c selected and determined as above has high rigidity and is resistant to heat distortion by the sun heat stress cycle. This makes it possible to fashion larger sized panels. During the installation process of the curtain wall, the frames of the honeycomb panel make up the joining portion with adjacent materials, because the panel is made large enough to cover the whole distance between floors. The frames are directly mounted on floor spurs with fasteners. Adjacent honeycomb panels are joined to the frames with packing material to enable the panels to slide to meet each other. Instead of conventional curtain walls that require installation of panels on frames and the mounting of frames on vertical sub-frames which are installed on the floor, simple structure curtain walls, which are also streamlined and functional, are made possible and increase effective floor space in the building.

This new honeycomb curtain wall and honeycomb panel used for the curtain wall have the abovementioned structures and functions. The composite honeycomb panel used in this invention is lightweight, of high rigidity and of good flatness thanks to resistance to heat distortion, so that it can be used as a large panel extending from one floor to the next. Furthermore, it can be directly mounted on the main frame of building without utilizing conventional vertical sub-frames or frames and can withstand its own weight and the outer pressure imposed on exterior walls of the building with its own rigidity, provided entirely by the composite honeycomb panel. Therefore many installation advantages can be expected and internal effective space can be enlarged due to reduced wall thickness.

EMBODIMENT

The following is a description of the application of this invention.

For honeycomb panels, the honeycomb core is made from aluminum foil and aluminum alloy surface plates (JIS 3003 alloy) bonded together. For the honeycomb core, thickness of the honeycomb core material is set at 76 μm and cell size is set at ⅜" to achieve a degree of warp of less than 0.7 mm per 1 m. This is shown in FIG. 3, which shows the relationship between t/c relationship and degree of warp. Using a core of thickness 100 mm with an outer surface plate of 1.5 ram thickness and inner surface plate of 0.8 mm thickness bonded on both sides of the core, a 102.3 mm thick honeycomb panel is made of width 6000 mm and length 3000 mm. Heat insulating materials are affixed to the backside of the honeycomb panel.

Figure 4:
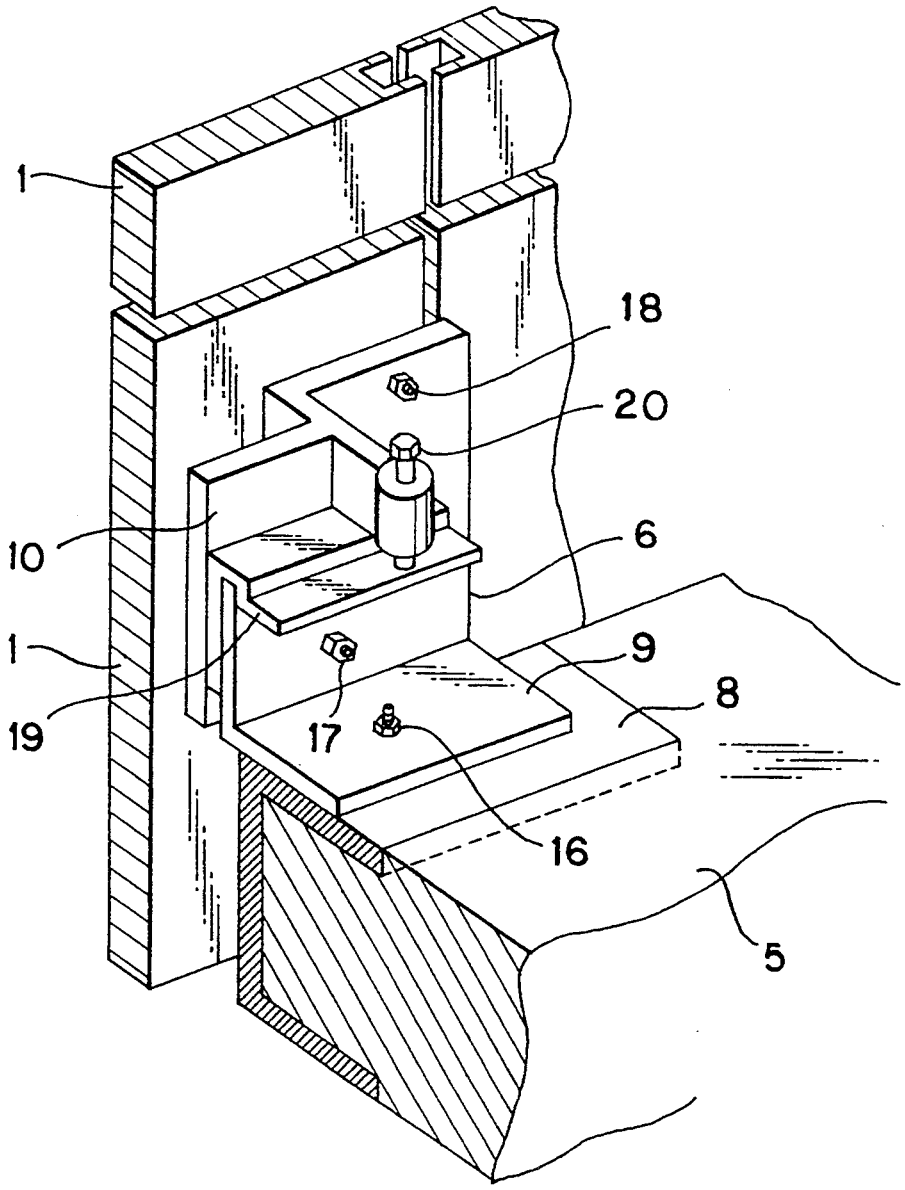
FIG. 4 shows an illustration of the mounting details of the new honeycomb curtain wall.

The honeycomb panel is installed on the main frame of a building using fasteners as shown in FIG. 4. The upper frame of the honeycomb panel is mounted on the floor 5 with fastener 6. The fastener 6 is composed of a recessed fastener 8, a primary fastener 9 and a secondary fastener 10. The angle shaped primary fastener 9 is mounted on the recessed fastener 8 buried in the floor 5 with a nut and bolt 16. The secondary fastener 10 is connected to the primary fastener 9 with a nut and bolt 17 through an intermediate 19.20 is a level adjustment bolt provided on the intermediate 19 to control the position of the secondary fastener 10 against the primary fastener 9.

Figure 5:
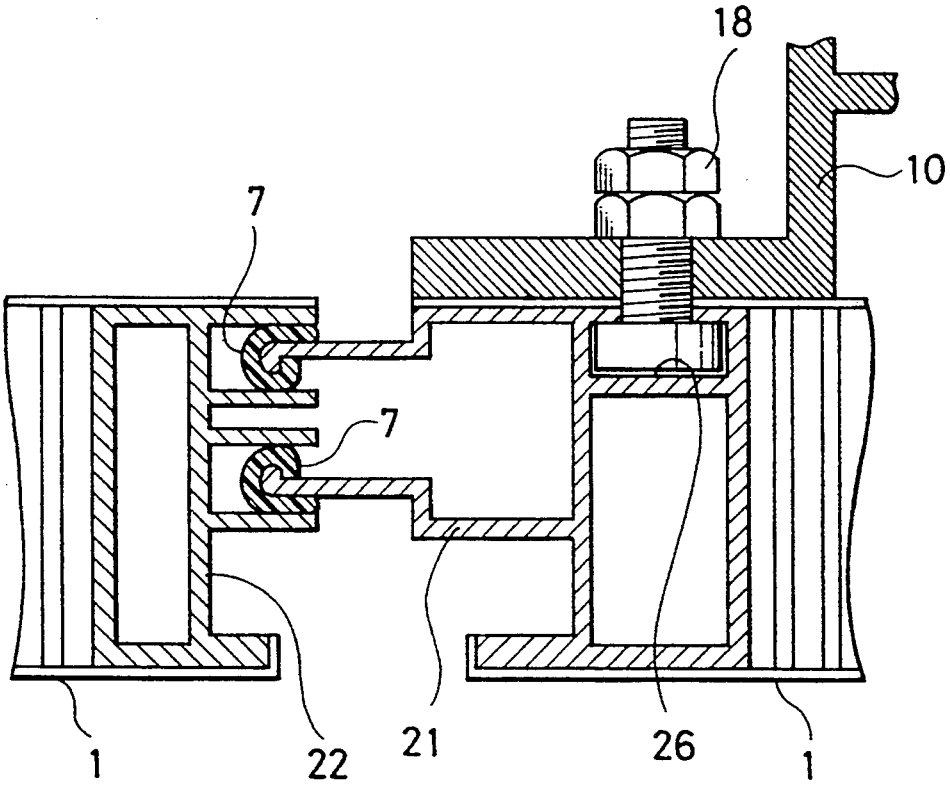
FIG. 5 shows a cross-sectional view of the mounting method of the new honeycomb wall and joined conditions of adjacent honeycomb panels.
Figure 6:
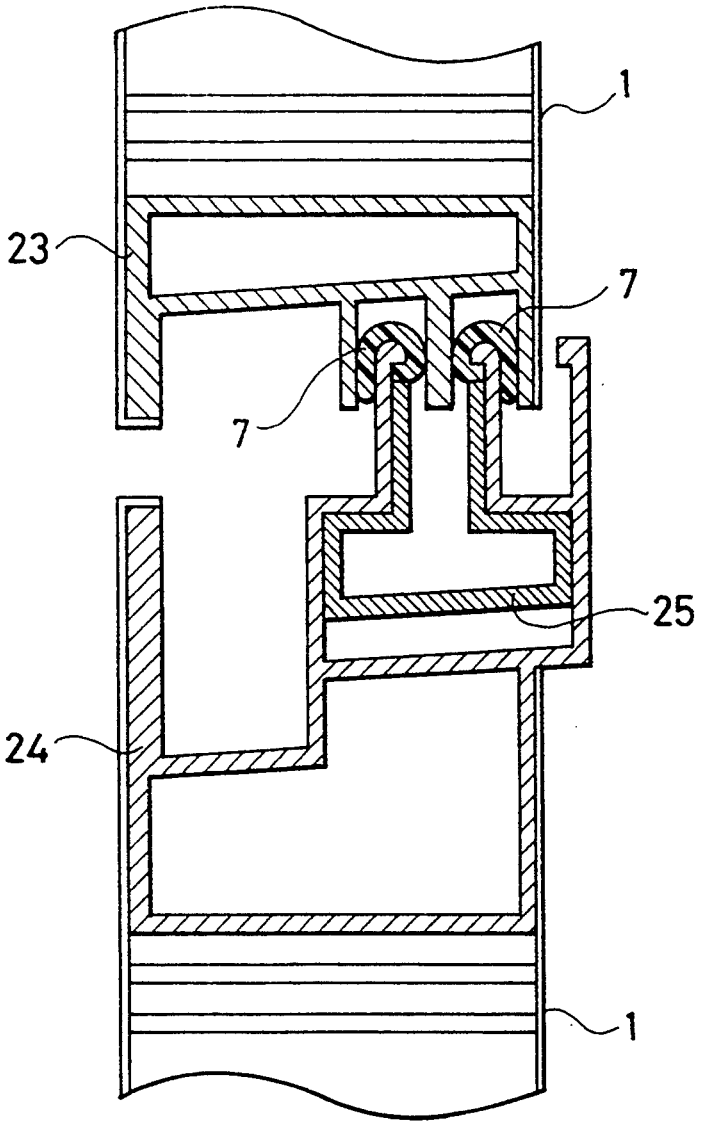
FIG. 6 shows a cross-sectional view of the joining condition of adjacent honeycomb panels in the new honeycomb curtain wall.

Mounting the honeycomb panel on the secondary fastener 10 is made with a bolt head through a hollowed portion of the frame 21 placed at the edge of honeycomb core as shown in FIG. 5. The secondary fastener 10 has a large hole to allow for heat expansion of the honeycomb panel. Side by side joining of honeycomb panels is done using packing 7 and frames 21 and 22 located at the edge of the honeycomb core having male/female connectors as shown in FIG. 5. Adjacent upper and lower honeycomb panels are connected using packing 7 and frames 23, 24 and 25 located at the edge of honeycomb core having male/female connectors as shown in FIG. 6. For glass panels placed between honeycomb panels, the glass panel is also mounted between the frames using packing.

Figure 7:
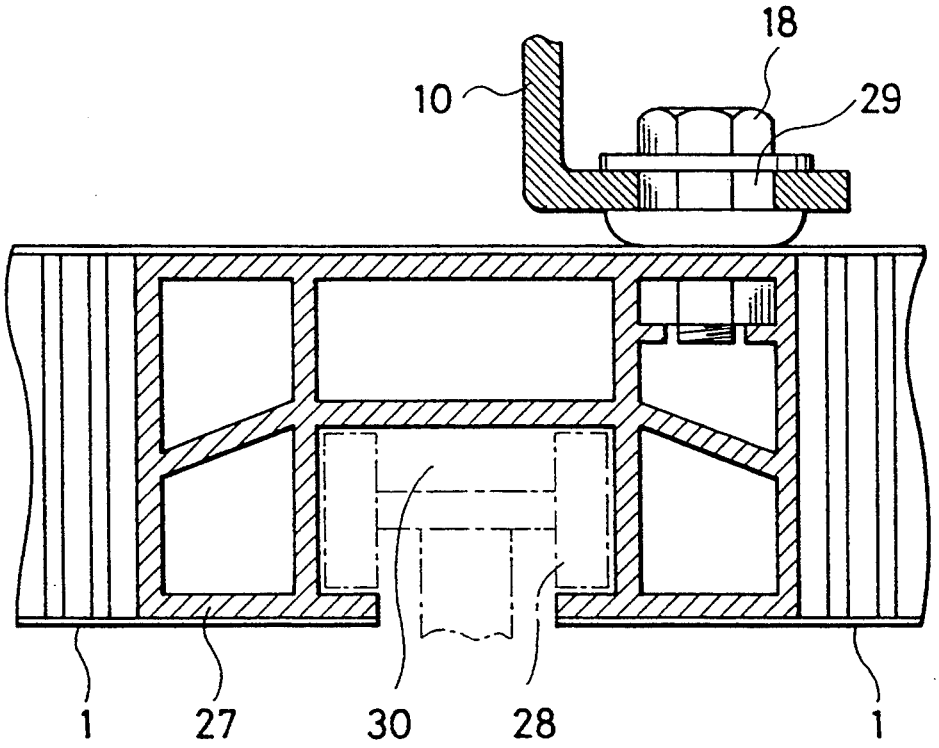
FIG. 7 shows a cross-sectional view of the conditions of use of the new honeycomb panel with inner frames.
Figure 8:
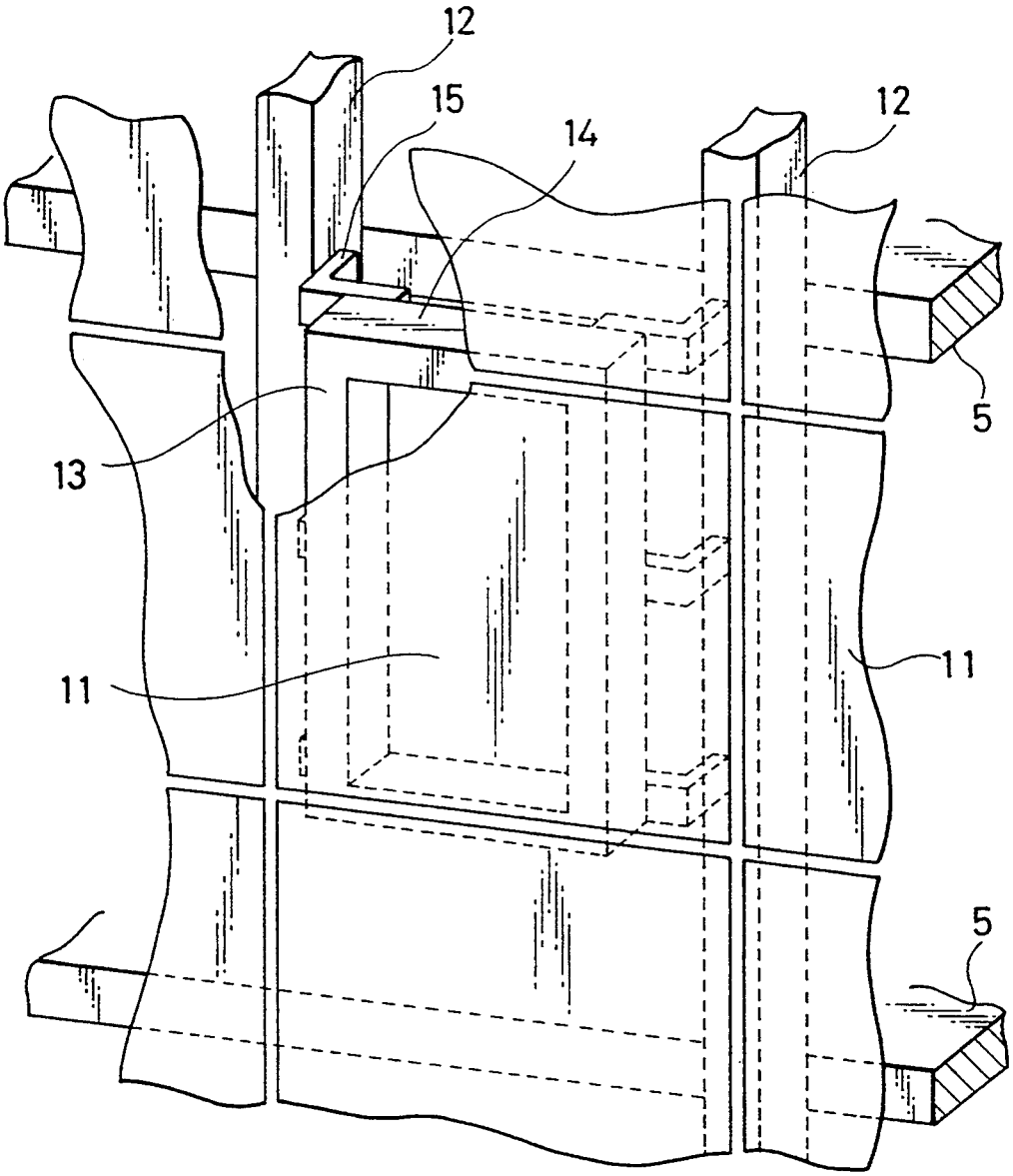
FIG. 8 shows an illustration of the mounting method of a conventional curtain wall.

FIG. 7 shows a honeycomb panel i with inner frame 27 in place. The honeycomb panel is mounted on the main frame with a nut and bolt 18 and a secondary fastener 10. The inner frame 27 has a guide rail 30 for the roller 28 of an exterior cleaning gondola. 29 is a large hole made in the second fastener 10 to absorb the heat expansion of the honeycomb panel 1.

The above honeycomb panel provided by this invention is lightweight, has high rigidity and is resistant to heat distortion, allowing large size panels to be used to sufficiently cover floors. They be mounted directly on the building main frame if the panel is utilized for the curtain wall. Therefore, an excellent curtain wall structure is provided, which has the additional advantage of a simple installation process. This increases effective room space in the building because of reduced total panel thickness. The panel also features good sound and impact energy absorption.

What is claimed is:

1. An external building wall structure comprising a honeycomb curtain wall formed from a plurality of composite honeycomb panels disposed in side-by-side relationship, each of the composite honeycomb panels comprising a honeycomb core sandwiched between two plates and a frame member having a thickness equal to the honeycomb core provided at the periphery of the honeycomb core and between the two plates, each of the composite honeycomb panels having a thickness of at least 45 mm and is capable of supporting an external force applied to the external building wall structure solely through the rigidity thereof, said frame member being directly secured to a building structure through a set of metal brackets and serving as a connection member for joining with an adjacent composite honeycomb panel or glass panel through an adjacent frame member provided therewith, the adjacent frame members having a packing material provided therebetween for enabling adjacent panels to have sliding movement with respect to each other.

2. The external building wall structure of claim 1, wherein an internal frame member other than the peripheral frame members is installed within the composite honeycomb panel.

3. The external building wall structure of claim 1, wherein the honeycomb panel is affixed with an insulation material on the rear side thereof.

4. The external building wall structure of claim 1, wherein the honeycomb panel has a thickness of 80 mm or more.

5. The external building wall structure of claim 1, wherein adjacent panels are a composite honeycomb panel and a glass panel and a frame member provided at the periphery of the composite honeycomb panel form part of a frame in which the glass panel is contained, said frame member having a packing material provided between it and said glass panel.

6. The external building wall structure of claim 1, wherein the composite honeycomb panel has a degree of deformation induced from thermal stress per unit length in a vertical direction to the surface of the panel of less than a specified value determined by the relationship between the deformation amount of the panel per unit length and t/c, t being the thickness of the material making up the honeycomb core and c being the cell size of cells forming the honeycomb core.

7. The external building wall structure of claim 1, wherein the composite honeycomb panel is of a length that it extends between adjacent floors of the building structure.

8. The external building wall structure of claim 1, wherein said honeycomb core comprises aluminum foil having a thickness of from 50–100 μm.

9. The external building wall structure of claim 1, wherein said composite honeycomb panel has a degree of deformation of less than 1.5 mm per meter.

10. The external building wall structure of claim 1, wherein said composite honeycomb panel is mounted directly on a main frame of the building structure.

11. The external building wall structure of claim 1, wherein said composite honeycomb panel has an upper frame member mounted on a floor of the building structure through a fastener member, said fastener member comprising a recessed fastener, a primary angle-shaped fastener and a secondary fastener, said recessed fastener being contained within the floor and having an upper surface thereof attached to a lower surface of said primary angle-shaped fastener, said secondary fastener having a back surface thereof directly attached to said composite honeycomb panel and a front surface thereof connected to said primary fastener through an intermediate member provided between said primary and secondary fasteners.

12. The external building wall structure of claim 11, additionally comprising a level adjustment member provided on said intermediate member for controlling the level of the secondary fastener with respect to the primary fastener.

* * * * *